US010750891B2

(12) United States Patent
LaGarde

(10) Patent No.: US 10,750,891 B2
(45) Date of Patent: Aug. 25, 2020

(54) PUMP OPERATED LID

(71) Applicant: Luc LaGarde, Kissimmee, FL (US)

(72) Inventor: Luc LaGarde, Kissimmee, FL (US)

( * ) Notice: Subject to any disclaimer, the term of this patent is extended or adjusted under 35 U.S.C. 154(b) by 0 days.

(21) Appl. No.: 16/048,619

(22) Filed: Jul. 30, 2018

(65) Prior Publication Data

US 2019/0029448 A1 Jan. 31, 2019

Related U.S. Application Data

(60) Provisional application No. 62/538,307, filed on Jul. 28, 2017.

(51) Int. Cl.

| | |
|---|---|
| ***A47G 19/22*** | (2006.01) |
| ***F04B 23/02*** | (2006.01) |
| ***B65D 83/00*** | (2006.01) |
| ***F04F 1/06*** | (2006.01) |
| ***B05B 9/08*** | (2006.01) |
| *B65D 47/06* | (2006.01) |

(52) U.S. Cl.

CPC ..... *A47G 19/2272* (2013.01); *A47G 19/2266* (2013.01); *B05B 9/0811* (2013.01); *B65D 83/00* (2013.01); *F04B 23/028* (2013.01); *F04F 1/06* (2013.01); *B65D 47/06* (2013.01); *B65D 2231/022* (2013.01)

(58) Field of Classification Search

CPC ..... A47G 19/2272; B05B 1/00; B65D 47/96; B65D 2231/022; B65D 25/38

USPC ..... 222/400.8, 401, 63, 61, 52, 399, 400, 5, 222/400.7, 333, 334; 220/703, 705–709; 215/387–389; 224/148.2

See application file for complete search history.

(56) References Cited

U.S. PATENT DOCUMENTS

| | | | | |
|---|---|---|---|---|
| 4,174,743 | A * | 11/1979 | Beny | B67D 1/0431 137/212 |
| 5,111,946 | A * | 5/1992 | Glanz | B65D 51/002 215/247 |
| 5,127,808 | A * | 7/1992 | Nichols | B62J 11/00 417/234 |
| 6,968,870 | B1 * | 11/2005 | Tsay | B65B 31/047 141/65 |
| 7,131,556 | B2 * | 11/2006 | Tseng | B67D 1/0431 222/64 |
| 8,097,159 | B1 * | 1/2012 | Peng | C02F 1/003 210/244 |
| 8,460,234 | B1 * | 6/2013 | Duron-Smith | A61J 15/0011 604/77 |

(Continued)

*Primary Examiner* — Lien M Ngo

(74) *Attorney, Agent, or Firm* — Boudwin Intellectual Property; Daniel Boudwin

(57) ABSTRACT

A pump operated lid that pushes liquid through the lid. The pump operated lid includes an enclosure having an interior volume and an outer perimeter, wherein the outer perimeter is designed to removably secure to a cup. An air pump is within the interior volume along with a power source and a control circuit, each operably connected to the air pump. A switch is on the enclosure and operably connected to the air pump, such that the switch is designed to activate the air pump. One or more valves are on the upper surface and designed to allow air into the interior volume when the air pump is activated. An aperture is on the upper surface and extends through the enclosure and is designed to receive a straw therethrough.

20 Claims, 11 Drawing Sheets

(56) References Cited

U.S. PATENT DOCUMENTS

| | | | | |
|---|---|---|---|---|
| 8,568,351 | B2 * | 10/2013 | Thalab | A61J 9/00 215/11.1 |
| 9,346,607 | B2 * | 5/2016 | Madjar | B65D 83/00 |
| 2003/0218076 | A1 | 11/2003 | Farnsworth et al. | |
| 2004/0069008 | A1 * | 4/2004 | Kreutzmann | A42B 3/048 62/457.2 |
| 2005/0268985 | A1 * | 12/2005 | Litto | B67D 1/0462 141/67 |
| 2006/0021999 | A1 * | 2/2006 | Jonjic | A45F 3/16 222/333 |
| 2008/0308646 | A1 | 12/2008 | Wu | |
| 2010/0092309 | A1 | 4/2010 | Hockemeier | |
| 2010/0096040 | A1 * | 4/2010 | Litto | B67D 1/0431 141/95 |
| 2011/0127258 | A1 | 6/2011 | Chodosh et al. | |
| 2018/0099105 | A1 * | 4/2018 | Pitcher | A61L 9/14 |

* cited by examiner

PUMP OPERATED LID

CROSS REFERENCE TO RELATED APPLICATIONS

This application claims the benefit of U.S. Provisional Application No. 62/538,307 filed on Jul. 28, 2017. The above identified patent application is herein incorporated by reference in its entirety to provide continuity of disclosure.

BACKGROUND OF THE INVENTION

The present invention relates to lids of drinking glasses. More specifically, the present invention provides a pump operated lid that uses an air pump to push air into the drinking glass forcing liquid inside the glass through an aperture or straw.

When drinking a beverage from a cup, mug, or tumbler, it is the user's responsibility to provide enough suctioning force to power the liquid through a straw to extract the beverage from the cup. However, it can be difficult for some people, such as children, disabled, or the elderly, to provide enough suction to receive the liquid through the straw. Additionally, it can be uncomfortable for some people to use a straw on a daily basis. Thus, there is a need for an improved force operated lid that is removably secure to a cup.

SUMMARY OF THE INVENTION

In view of the foregoing disadvantages inherent in the known types of lids now present in the known art, the present invention provides a pump operated lid wherein the same can be utilized for providing convenience for the user when operating a drink through a pump.

The present system comprises an enclosure having an interior volume and an outer perimeter, wherein the outer perimeter is configured to removably secure to a cup. An air pump is disposed within the interior volume along with a power source and a control circuit, each operably connected to the air pump. A switch is disposed on the enclosure and operably connected to the pump. One or more valves are disposed on the upper surface and configured to allow air into the interior volume when the air pump is actuated, such that the liquid within the cup is expelled out. An aperture is disposed on the upper surface and extends through the enclosure and configured to receive a straw therethrough thereby producing a waterproof and airproof seal.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1A:
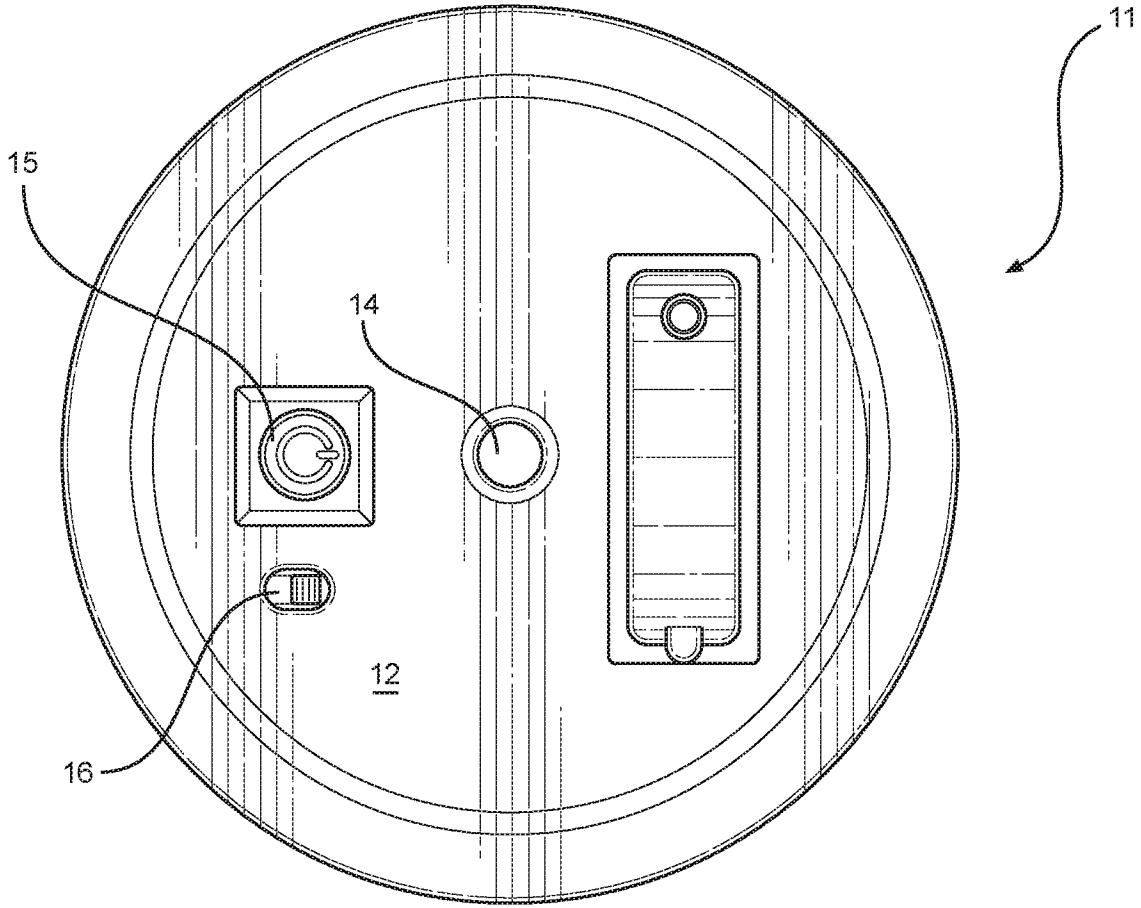
FIG. 1A shows a top down view of an embodiment of the pump operated lid.

Reference is made herein to the attached drawings. Like reference numerals are used throughout the drawings to depict like or similar elements of the pump operated lid. The figures are intended for representative purposes only and should not be considered to be limiting in any respect.

Figure 1B:
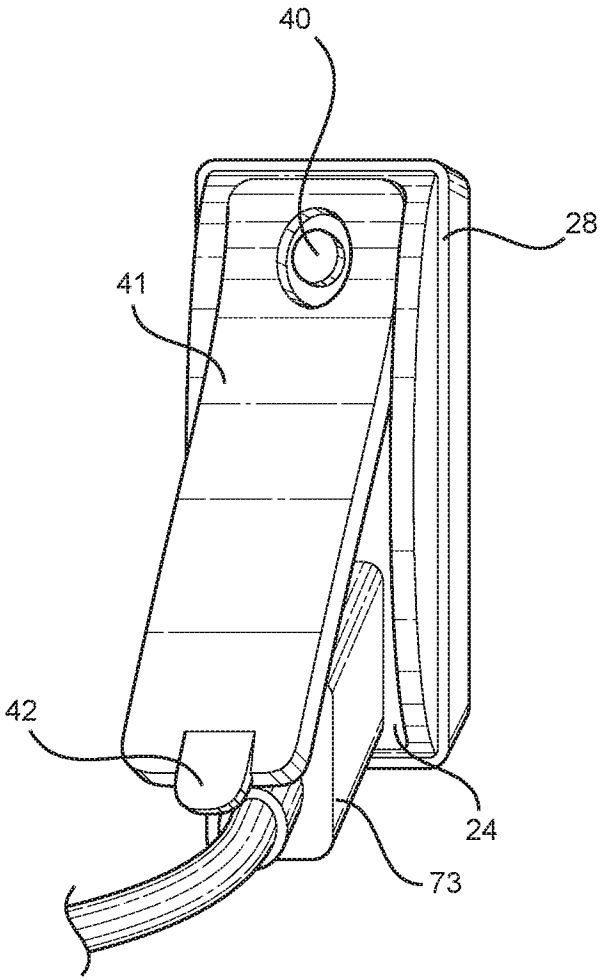
FIG. 1B shows a close-up view of an embodiment of the charging station on the pump operated lid.

Referring now to FIG. 1A and FIG. 1B, there is shown a top down view of an embodiment of the pump operated lid and a close-up view of an embodiment of the charging station on the pump operated lid, respectively. A pump operated lid 11 comprises an enclosure having an interior volume defined by an outer perimeter. The pump operated lid 11 further comprises an upper surface 12 configured to enclose the interior volume, such that a seal is created thereby waterproofing the interior volume to prevent any liquid from entering the interior volume. In the shown embodiment, the upper surface 12 is transparent, such that the user can easily discern any problems with the mechanics of the pump operated lid 11. The pump operated lid 11 further comprises one or more valves operably connected an air pump disposed within the interior volume. The valve is configured to allow air into the interior volume.

An aperture 14 is disposed on the upper surface 12, wherein the aperture 14 extends through the interior volume, and is configured to receive a straw, pipe, or tube therethrough A switch 15 is disposed on the upper surface 12, wherein the switch is operably connected to the air pump disposed within the pump operated lid, such that when the switch 15 is actuated, the air pump responds accordingly. In the illustrated embodiment, the switch 15 comprises a biased switch, such as a push button switch, wherein holding the switch 15 completes the circuit and actuates the air pump. However, in other embodiments, the switch 15 comprises a togglable switch such that the air pump can be toggled on or off. In an additional embodiment, the switch 15 comprises a force sensor that corresponds to the amount of air produced by the air pump, such that the harder the switch 15 is pressed the greater the power produced by the air pump, thereby allowing a user to adjust the flow rate of liquid through the straw.

Additionally, in the illustrated embodiment, a light switch 16 is disposed on the upper surface 12, wherein the light switch 16 is operably connected to a plurality of lights disposed within the enclosure of the pump operated lid 11. In the shown embodiment, the light switch 16 is a toggle switch configured to respond to a plurality of options equivalent to the plurality of lights within the enclosure, respectively, such as moving the light switch in one direction actuates a blue light. The light switch 16 is toggleable, such that a user can not only control which light to use but whether to actuate any lights.

The pump operated lid 11 further comprises a charging station 28 having a USB port 24 configured to accept a USB cord 73 therein. In the illustrated embodiment, the charging station 28 is disposed on the upper surface 12 of the pump operated lid 11. The charging station 28 is protected by a cover 41 having a tab 42 at one end configured to allow a user to easily lift the cover 41 thereby exposing USB port 24. Additionally, in the shown embodiment, an indicator light 40 is disposed atop the cover 41, wherein the indicator light 40 is operably connected to the USB port 24. In this way, the indicator light 40 is configured to actuate when the USB cord 73 is inserted into the USB port 24, thereby indicating the charging station 28 is charging. In the illustrated embodiment, the charging station 28 can be utilized to either recharge a rechargeable battery disposed within the enclosure or to recharge an electronic device, such as a cell phone.

Figure 1C:
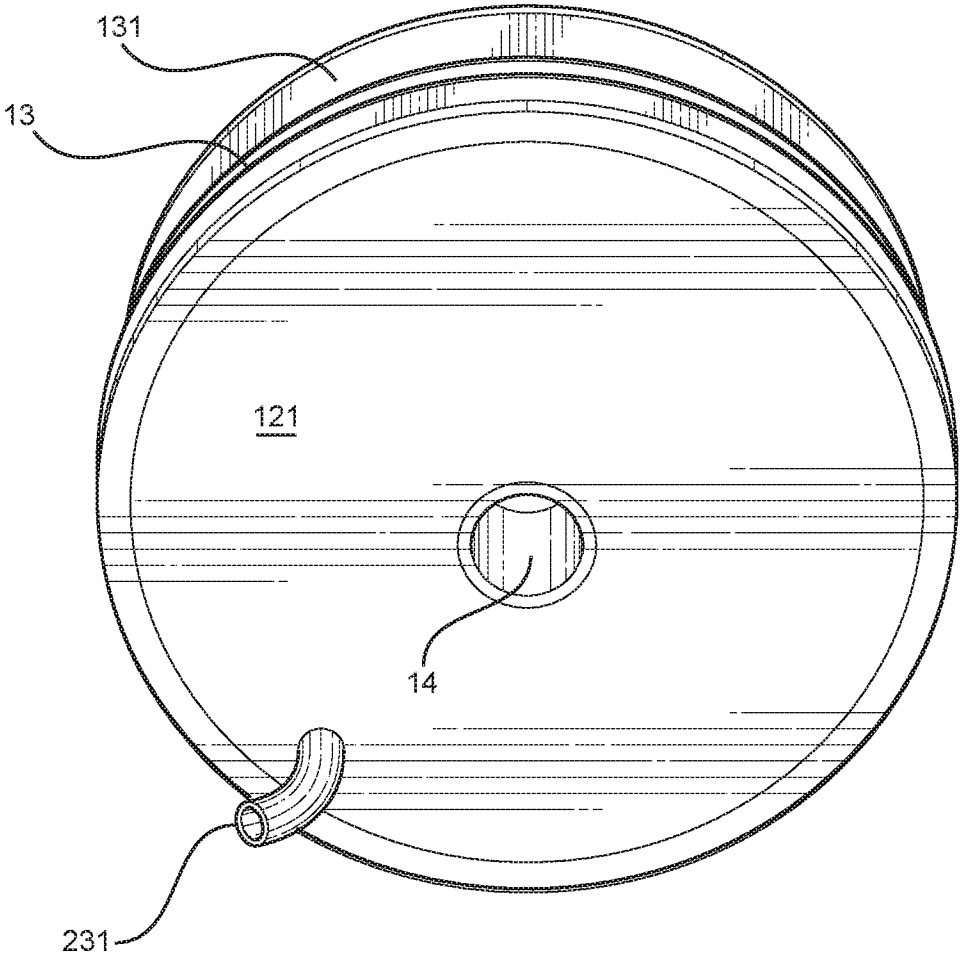
FIG. 1C shows a perspective view of an embodiment of the lower surface of the pump operated lid.

Referring to FIG. 1C, there is shown a perspective view of an embodiment of the lower surface of the pump operated lid. The interior of the pump operated lid is defined by an outer perimeter 13 configured to secure to a cup thereby creating a seal. The seal is configured to be secure such that the pump operated lid is not pushed out of the cup when the air pump is utilized. In the illustrated embodiment, the outer perimeter 13 is threaded and sized such that it can friction fit within an interior of the cup. However, in other embodiments, the outer perimeter 13 is threaded and sized such that it can screw into an interior of an upper portion of the cup.

The interior is further defined by a lower surface 121. The lower surface 121 is smaller than the upper surface of the pump operated lid, such that a flange 131 is created where the upper surface overlaps the lower surface 121. The flange 131 is configured to rest atop a perimeter of a cup or tumbler when the pump operated lid is disposed within the cup. Additionally, an extension 231 of the air pump extends through the lower surface, wherein the extension 231 is operably connected to the air pump. The extension 231 allows the air pump push air into the cup from the air surrounding pump operated lid. In this way, a pressure differential is created that forces liquid through the straw out of the aperture 14 at a controlled rate.

Figure 2:
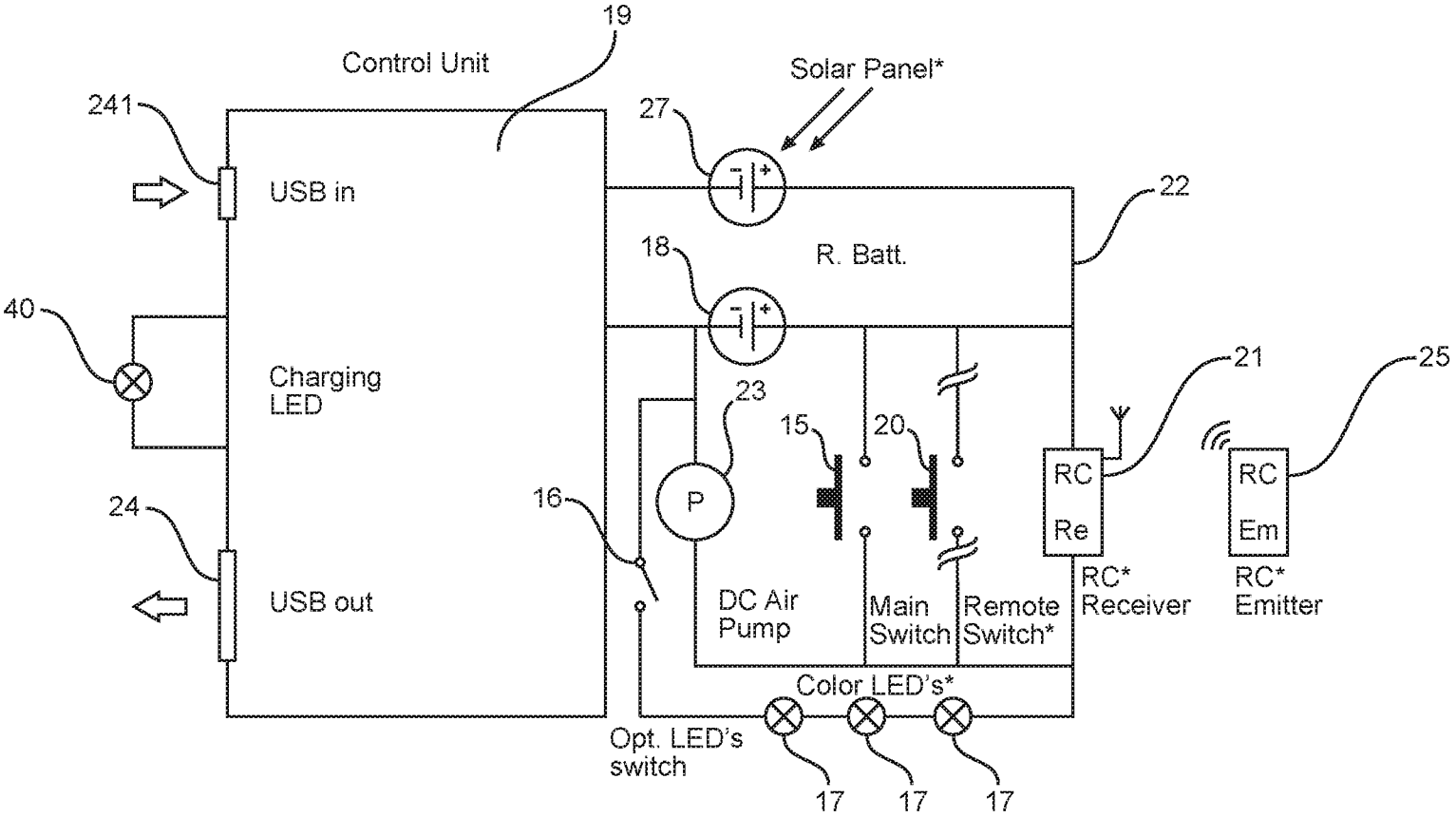
FIG. 2 shows a schematic of an embodiment of the interior electronics of the pump operated lid.
Figure 3A:
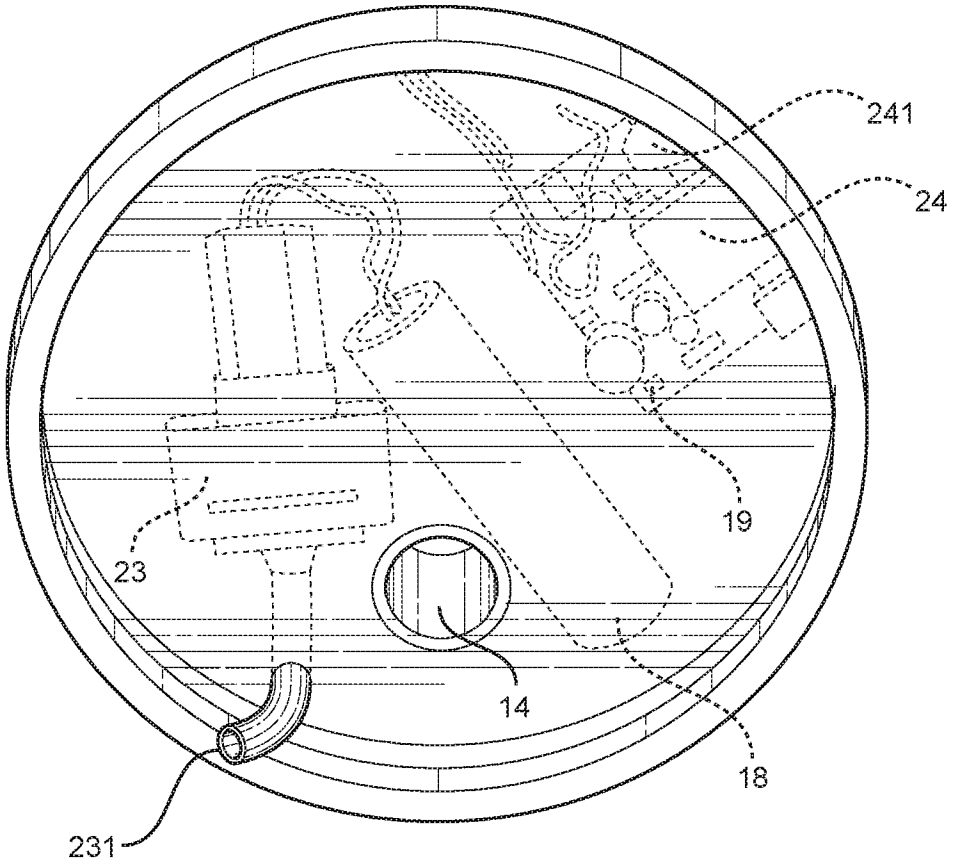
FIG. 3A shows a perspective view of an embodiment of the lower surface and interior of the pump operated lid.

Referring now to FIG. 2 and FIG. 3A, there is shown a schematic of an embodiment of the pump operated lid and the interior electronics of an embodiment of the pump operated lid, respectively. The pump operated lid is configured to function through the use of a control circuit 19 disposed within the interior of the pump operated lid that controls the actions of the pump operated lid. The control circuit 19 is powered through a power source 18, such as a rechargeable battery. Additionally, the control circuit 19 is connected to a USB port 24 as well as a micro USB port 241. In the illustrated embodiment, the micro USB port 241 is configured to accept a micro USB cable therein and thereby provide a charge to the pump operated lid, whereas the USB port 24 is configured to draw a charge from pump operated lid. The indicator light 40 is illustrated as an LED and configured to actuate when the user is providing power to the pump operated lid, thereby indicating that the pump operated lid is charging.

The air pump 23 disposed within the interior of the pump operated lid is operably connected to the control circuit 19 and powered by the rechargeable battery 18. The control circuit 19 is configured to control the amount of power the air pump 23 receives, such that the air pump 23 is not accidentally overheated. The air pump 23 is operably connected to the switch 15 disposed on the upper surface of the pump operated lid, such that the switch 15 actuates the air pump 23. When the air pump 23 is actuated, air is pulled through the valve on the upper surface of the pump operated lid and pushed through the extension of the air pump 23 into the interior of the cup. In this way, air is pumped into the interior of the cup thereby increasing the interior pressure and pushing the liquid out through the straw.

In one embodiment, a remote switch 20 is disposed on the pump operated lid, such that the pump operated lid can be configured to respond to a remote control 25. Additionally, the remote switch 20 is operably connected to a remote control receiver 21 configured to receive the radio waves emitted by the remote control 25. In this way, when the remote switch 20 is actuated, the pump operated lid can receive power instructions from the remote control 25 through the remote control receiver 21.

In the illustrated embodiment, a plurality of lights 17, such as color LEDs, is additionally disposed within the interior of the pump operated lid and joined to the circuit. The plurality of LEDs 17 is operably connected to the light switch 16, such that actuating the light switch 16 will actuate one LED light from the plurality of LEDs 17. In this way, the light 17 aids the user in utilizing the pump operated lid, as well as providing an enjoyable decorative element to the pump operated lid.

In one embodiment, the pump operated lid further comprises a solar panel 27 configured to provide power to the rechargeable battery 18 and operably connected to the control circuit 19. In the illustrated embodiment, a plurality of wires 22 are utilized to connect the electronics disposed within the interior of the pump operated lid.

Figure 3B:
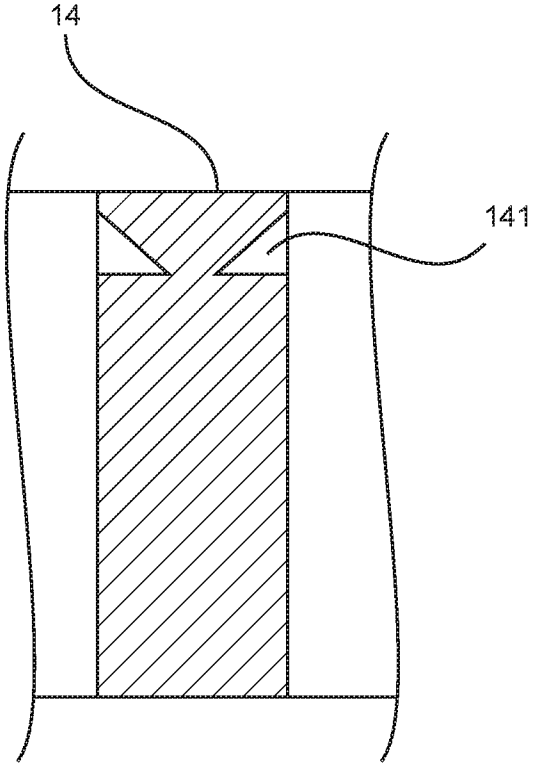
FIG. 3B shows a cross-sectional view of an embodiment of the aperture of pump operated lid.

Referring now to FIG. 3B, there is shown a cross-sectional view of an embodiment of the aperture of the pump operated lid. The aperture 14 is waterproof, such that any liquid inside the aperture 14 is separate from the interior volume 20 and any electronics therein. The aperture 14 is configured to receive a straw therethrough in close tolerance to the aperture such that the straw is retained in an upright position. In the illustrated embodiment, the aperture 14 is shown having two rubber protrusions 141 disposed opposite one another within the aperture 14. The rubber protrusions 141 are configured to create a seal around the straw when inserted into the aperture 14, such that air and water cannot pass through the aperture 14 around the straw.

Figure 4A:
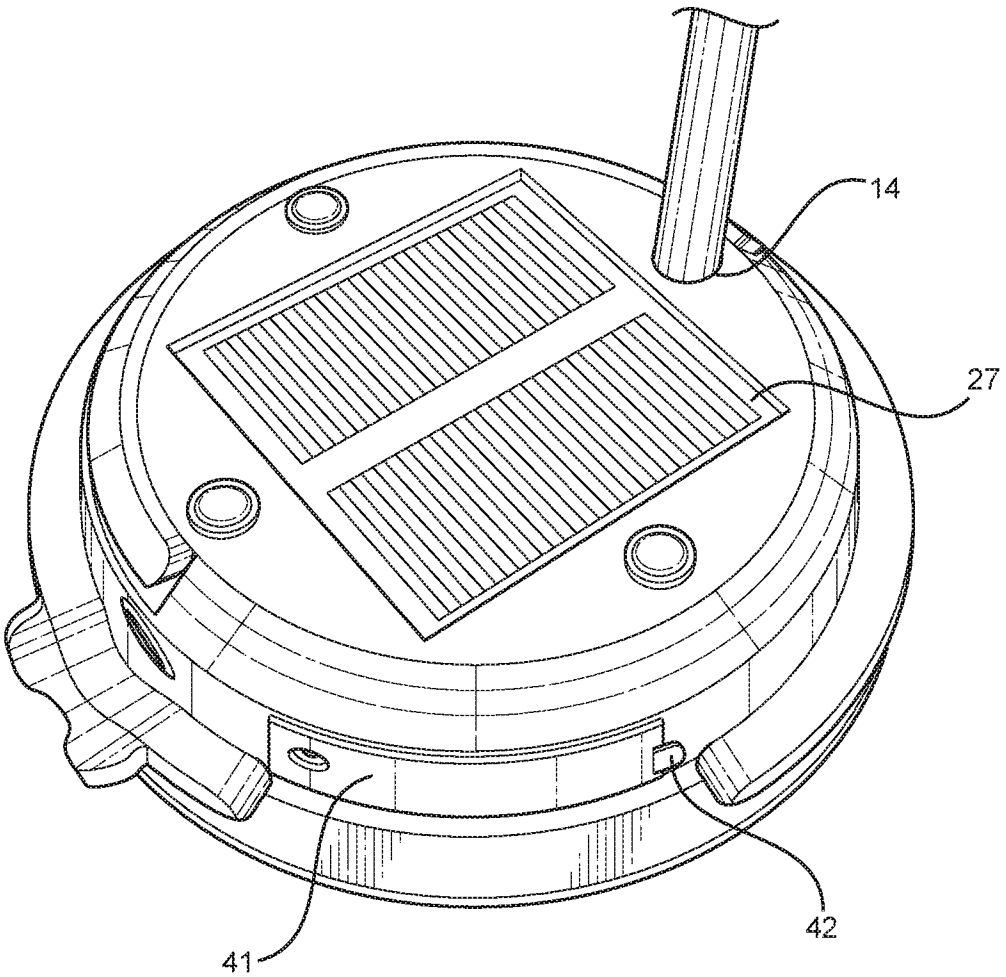
FIG. 4A shows a top perspective view of an embodiment of the pump operated lid with a solar panel.
Figure 4B:
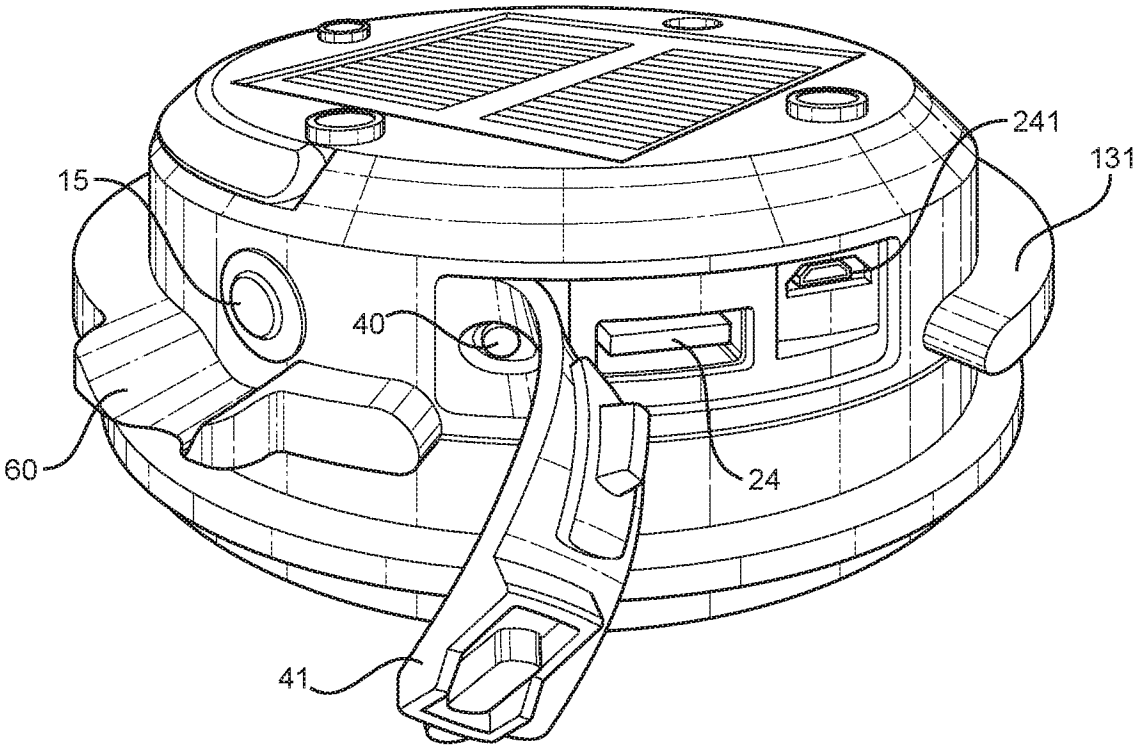
FIG. 4B shows a side perspective view of an embodiment of the pump operated lid with a solar panel.

Referring now to FIG. 4A and FIG. 4B, there is shown a top and side perspective view of an embodiment of the pump operated lid with a solar panel, respectively. In one embodiment, the pump operated lid further comprises a solar panel 27 disposed on the upper surface of the pump operated lid. As previously mentioned above, the solar panel 27 is operably connected to the rechargeable battery. In this way, the solar panel 27 can be utilized to provide a charge to the rechargeable battery. In the illustrated embodiment, the aperture 14 is still disposed on the upper surface of the pump operated lid, wherein the aperture 14 is disposed such that it does not interfere with the utility of the solar panel 27.

In the illustrated embodiment, the charging station is disposed on a sidewall of the pump operated lid. In the illustrated embodiment, the cover 41 provides protection for the USB port 24 and micro USB port 241. The addition of the solar panel 27 allows a user to draw power from the rechargeable battery using the USB port 24 or the micro USB port 241, per the configuration of the circuit, while the solar panel 27 provides energy to the rechargeable battery.

In the illustrated embodiment, the flange 131 is disposed such that it does not interfere with the use of the charging station, such that the flange 131 does not overlap the cover 41 and tab 42. This allows the user to easily remove the cover 41 to utilize the USB port 24 without impedance from the flange 131. The flange 131 is disposed such that it does not block the indicator light 40, thereby ensuring that there is still a visual indicator when a device is utilizing the USB port 24 or micro USB port 42.

Additionally, in the illustrated embodiment the switch 15 is also disposed on the sidewall of the pump operated lid. In the shown embodiment, the flange 131 extends further out where it aligns with the switch 15 in a curved protrusion 60. The curved protrusion 60 provides a physical indicator for the user on where to place a finger to utilize the switch 15, thereby making it easier for the user to find the switch 15. Further, the curved protrusion 60 ensures that it is not uncomfortable for the user to continually push the switch 15 by giving the user's finger a support when pushed. In the illustrated embodiment, the switch 15 comprises a plurality of flow rate adjustments, such that actuating the switch 15 once generates a first flow rate, actuating the switch 15 a second time generates a second flow rate, and actuating the switch 15 a third time turns discontinues the power to the air pump.

Figure 5A:
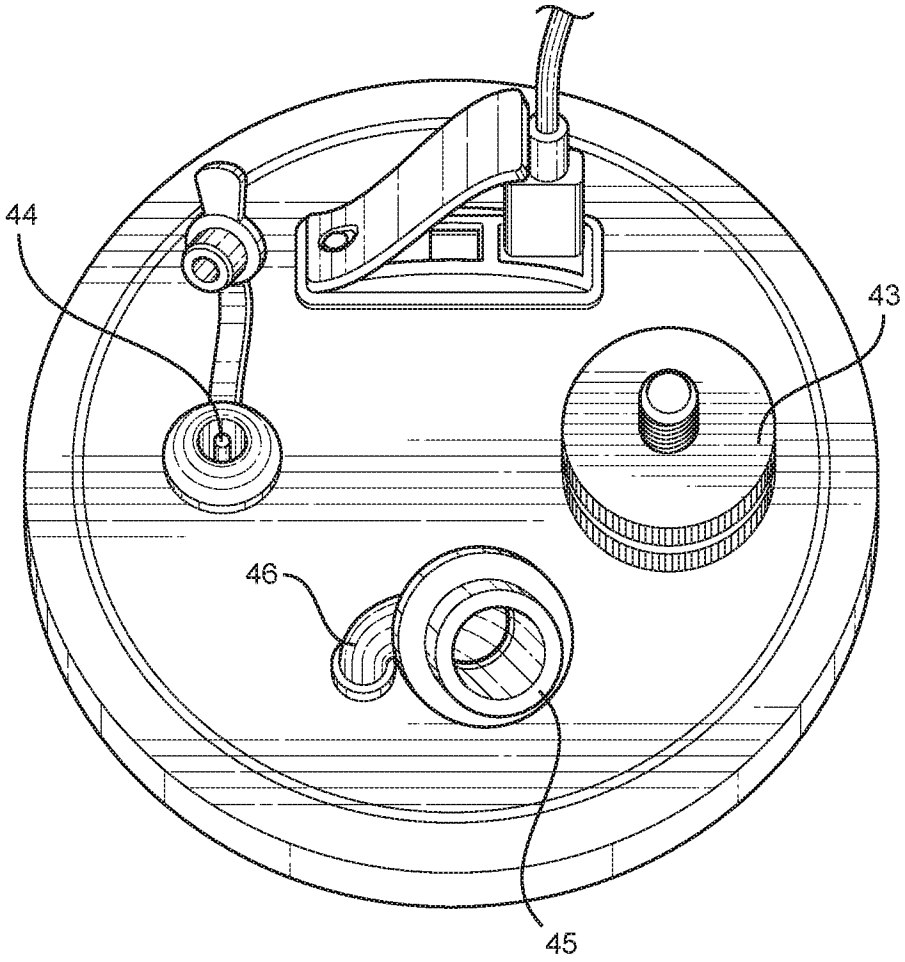
FIG. 5A shows a perspective view of an embodiment of the pump operated lid configured for medical use.
Figure 5B:
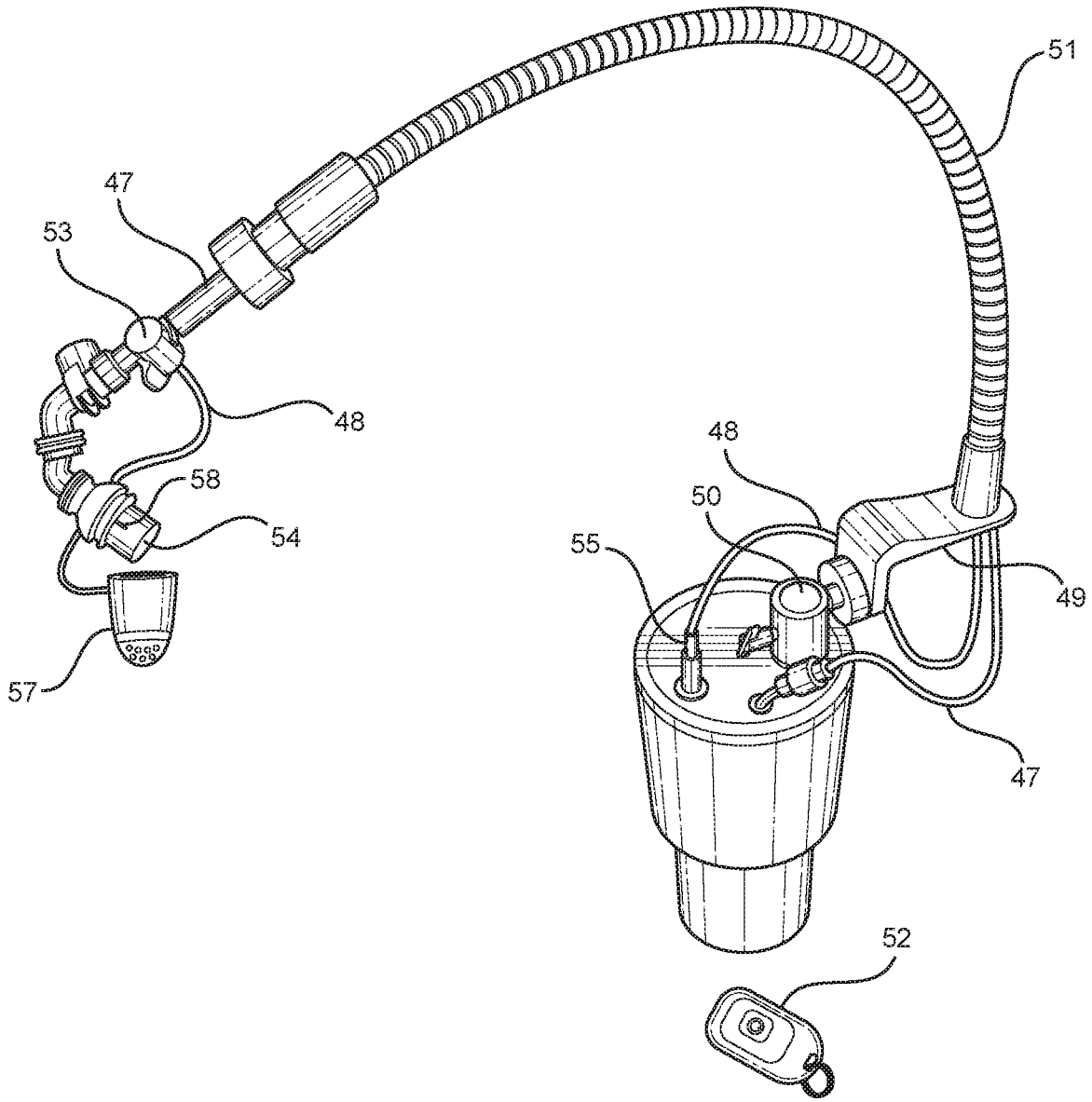
FIG. 5B shows a perspective view of an embodiment of the pump operated lid with an extended straw attachment for medical use.

Referring now to FIGS. 5A and 5B, there is shown an embodiment of the pump operated lid configured for medical use and an embodiment of the pump operated lid with an extended straw for medical use. In a further embodiment, the pump operated lid is configured to operate with a medical tube 51, wherein the upper surface of the pump operated lid further comprises an internal straw 46 operably connected to a connector 45. The internal straw 46 is configured to rest within the cup or tumbler, wherein connector 45 is configured to accept the internal straw 46 through a first end and accept an extended straw 47 through a second end. In this way, the internal straw 46 and connector 45 utilize the aperture of the pump operated lid.

In the illustrated embodiment, a screw joint 43 is disposed on the upper surface of the pump operated lid. The screw joint 43 is configured to removably secure to a support 50 for the medical tube 51. In the illustrated embodiment, the medical tube 51 is offset from the cup through the use of a protruding support 49. The medical tube 51 is flexible, such that the user can manipulate the medical tube 51 to reach a plurality of angles. The medical tube 51 is hollow and configured to accept the extended straw 47 therethrough.

Additionally, the medical tube 51 is configured to accept a control wire 48 therethrough, such that the control wire 48 runs parallel to the extended straw 47 through the medical tube 51. A control power port 44 is disposed on the upper surface of the pump operated lid configured to receive a control cord head 55 therein. In this way, the control wire 48 is operably connected to the control circuit disposed within the interior of the pump operated lid, such that it can be utilized as a switch to actuate the air pump.

A connector coupler 53 is operably connected to a distal end of the medical tube 51, wherein the distal end is opposite the end of the medical tube 51 connected to the cup. The connector coupler 53 is configured to accept the extended straw 47 and control wire 48 therethrough such that the extended straw 47 and control wire 48 are operably disposed within a bite nozzle 54, In one embodiment, the extended straw 47 is disposed outside the bite nozzle 54, however the control wire 48 is still disposed within the bite nozzle 54 to prevent external contact between the user and the electric cable within the control wire 48. In the illustrated embodiment, the bite nozzle 54 is comprised of silicon and is protected through a nozzle cover 57. The bite nozzle 54 has a center wherein a valve is disposed with one or more sensor switches 58 disposed on opposing sides of the valve. When a user bites down on the bite nozzle 54, the valve is opened, thereby providing a pressure to the sensor switches 58 disposed on either side of the valve. The sensor switches 58 then actuate the control wire 48, thereby actuating the air pump. When the air pump is actuated, liquid is forced through the extended straw 47 into the mouth of a user, such that the user can utilize the pump operated lid without physically pushing a button. In this way, users who are medically disabled can utilize the device. In the shown embodiment, the sensor switches 58 are disposed on the main body of the nozzle connector, such that the bite nozzle 54 can be replaced without damaging the sensor switches, thereby preventing the buildup of bacteria on the bite nozzle 54.

In the illustrated embodiment, a remote 52 is provided, wherein the remote 52 houses the remote control configured to actuate the air pump. The remote 52 is configured to communicate with the air pump through a wireless connection, such as Bluetooth. In this way, a nurse, doctor, or family member can utilize the remote 52 to actuate the pump operated lid in a more conventional manner, or on behalf of a person who is unable to utilize the bite nozzle 54.

Figure 6:
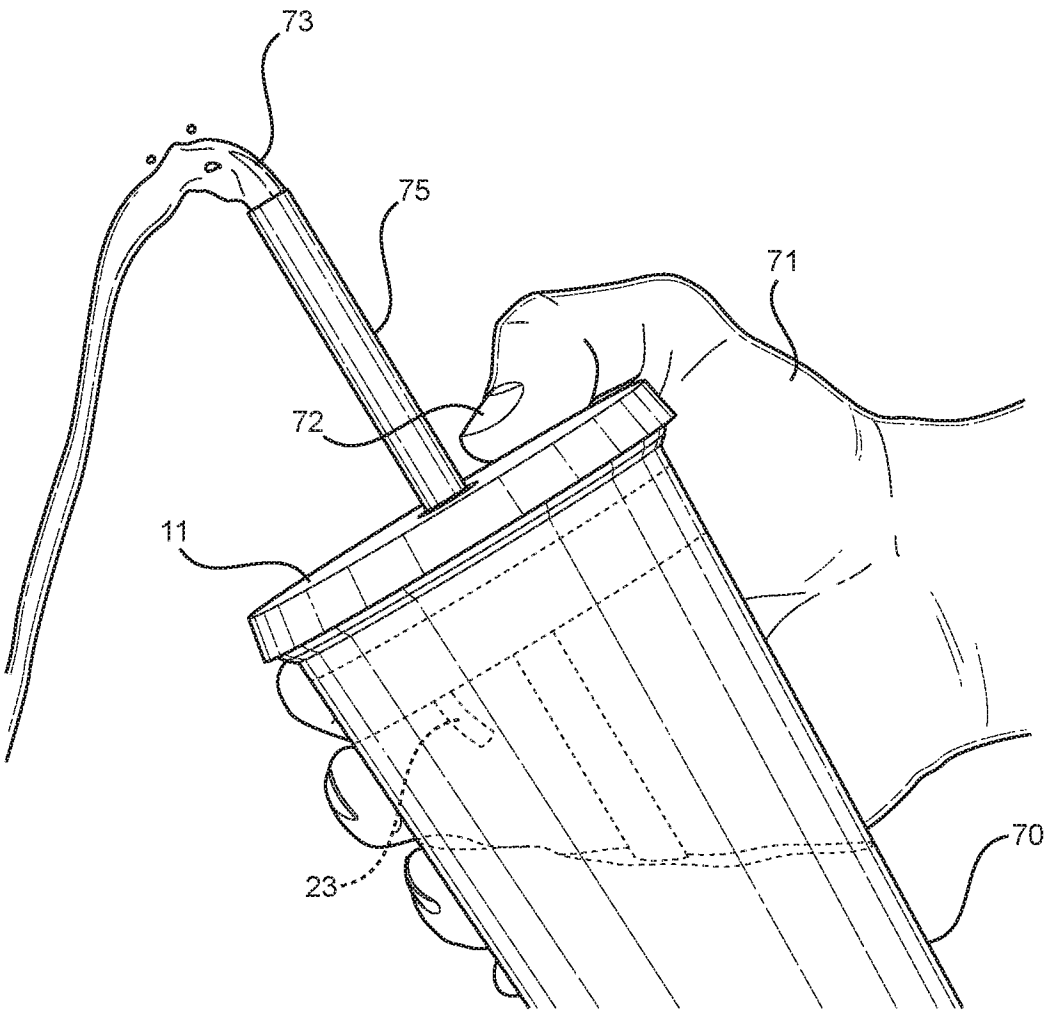
FIG. 6 shows a side view of an embodiment of the pump operated lid in use.

Referring now to FIG. 6, there is shown a side view of an embodiment of the pump operated lid in action. In operation, the pump operated lid 11 is removably secured to a cup 70, having some amount of liquid therein, with a straw 75 disposed within the cup 70. The user grasps the cup 70 such that their hand 71 is wrapped around the cup 70 and their thumb 72 can be manipulated to press the switch. Once the switch is actuated, the extension of the pump 23 pulls in air from inside the cup 70, thereby pushing the liquid through the straw 75, thereby creating a spout 73 of liquid.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pump operated beverage container lid, comprising:

an enclosure having an interior volume and an outer perimeter, wherein the outer perimeter is configured to removably secure to a beverage container;

an air pump disposed within the interior volume;

a power source disposed within the interior volume and operably connected to the air pump;

a switch disposed on the enclosure operably connected to the air pump such that actuating the switch actuates the air pump;

one or more valves disposed on an upper surface of the pump operated beverage container lid configured to allow air to pass through the interior volume when the air pump is actuated;

a control circuit disposed within the interior volume of the lid operably connected to the power source;

a charging station operably connected to the control circuit, wherein the charging station includes a USB port;

an aperture disposed on the upper surface and extending through the enclosure wherein the aperture is configured to receive a straw therethrough;

wherein attachment of the pump operated lid to the beverage container, insertion of the straw through the aperture, and actuation of the air pump, the air pump transfers an air from an exterior of the beverage container into the interior of the beverage container, wherein the air contacts a liquid inside the beverage container to displace the liquid upward through and out of the straw.

2. The pump operated beverage container lid of claim 1, wherein the power source comprises a rechargeable battery.

3. The pump operated beverage container lid of claim 1, wherein the enclosure is waterproof.

4. The pump operated beverage container lid of claim 1, wherein at least one of the one or more valves is vertically aligned with the air pump.

5. The pump operated beverage container lid of claim 1, wherein the USB port is disposed on the upper surface of the pump operated beverage container lid.

6. The pump operated beverage container lid of claim 1, wherein a solar panel is disposed on the inner portion.

7. The pump operated beverage container lid of claim 6, wherein the USB port is disposed on a sidewall of the inner portion.

8. The pump operated beverage container lid of claim 1, wherein one or more lights are disposed within the interior volume and operably connected to the control circuit.

9. The pump operated beverage container lid of claim 8, wherein a light switch is disposed on the upper surface of the pump operated lid configured to actuate the one or more lights disposed within the interior volume.

10. The pump operated beverage container lid of claim 1, further comprising:

a medical tube operably connected to the aperture at a distal end thereof;

a bite nozzle disposed at a proximal end of the medical tube, wherein a central valve is disposed within the bite nozzle;

wherein a force is applied to the bite nozzle, the central valve is opened, and the air is pump activated.

11. The pump operated beverage container lid of claim 1, wherein the switch is configured to respond respectively to the pump such that adjusting the switch adjusts a flow rate.

12. The pump operated beverage container lid of claim 1, wherein the switch comprises one or more settings, such that there are one or more set intervals for a flow rate.

13. The pump operated beverage container lid of claim 1, wherein the aperture has two rubber protrusions configured to create a seal when a straw is inserted therein, such that water and air cannot pass through the aperture.

14. The pump operated beverage container lid of claim 1, wherein an indicator light is disposed on the pump operated lid to indicate when the USB port is in use.

15. The pump operated beverage container lid of claim 1, wherein the switch comprises a force sensor.

16. The pump operated beverage container lid of claim 15, wherein the force sensor is operably connected to the air pump.

17. A pump operated beverage container lid, comprising:

an enclosure having an interior volume and an outer perimeter, wherein the outer perimeter is configured to removably secure to a beverage container;

an air pump operably connected to one or more valves, wherein actuation of the air pump, the air pump transfers an air from an exterior of the beverage container through the one or more valves and into an interior of the beverage container;

a power source, wherein the power source is operably connected to the air pump;

a switch, wherein the switch is operably connected to the air pump, wherein actuation of the switch, the air pump is actuated;

a control circuit, wherein the control circuit is operably connected to the power source;

a charging station operably connected to the control circuit, wherein the charging station includes a USB port;

an aperture disposed on the pump operated beverage container lid, wherein the aperture is configured to receive a straw therethrough;

wherein attachment of the pump operated beverage container lid to the beverage container, insertion of the straw through the aperture, and actuation of the air pump, the air pump transfers the air from the exterior of the beverage container into the interior of the beverage container, wherein the air contacts a liquid inside the beverage container to displace the liquid upward through and out of the straw.

18. The pump operated beverage container lid of claim 17, further comprising:

a medical tube operably connected to the aperture at a distal end thereof;

a bite nozzle disposed at a proximal end of the medical tube, wherein a central valve is disposed within the bite nozzle;

wherein a force is applied to the bite nozzle, the central valve is opened, and the air pump is activated.

19. The pump operated beverage container lid of claim 1, wherein the charging station recharges the power source and the power source recharges an external device.

20. The pump operated beverage container lid of claim 1, further comprising:

a remote control in operable communication with the control circuit;

the remote control configured to communicate with the control circuit via a wireless transmitter;

wherein upon wireless communication the remote control is configured to actuate and de-actuate the air pump.

* * * * *